US010044142B1

(12) United States Patent
Leon

(10) Patent No.: US 10,044,142 B1
(45) Date of Patent: Aug. 7, 2018

(54) CONNECTOR LOCKING HOLDER

(71) Applicant: Valeo North America, Inc., Troy, MI (US)

(72) Inventor: Emigdio Leon, Seymour, IN (US)

(73) Assignee: Valeo North America, Inc., Troy, MI (US)

( * ) Notice: Subject to any disclaimer, the term of this patent is extended or adjusted under 35 U.S.C. 154(b) by 0 days.

(21) Appl. No.: 15/582,138

(22) Filed: Apr. 28, 2017

(51) Int. Cl.
*H01R 13/639* (2006.01)
*H01R 13/04* (2006.01)
*H01R 13/627* (2006.01)
*F21V 23/06* (2006.01)

(52) U.S. Cl.
CPC ..... *H01R 13/639* (2013.01); *F21V 23/06* (2013.01); *H01R 13/04* (2013.01); *H01R 13/6278* (2013.01); *H01R 2201/26* (2013.01)

(58) Field of Classification Search
CPC ..... H01R 13/639
See application file for complete search history.

(56) References Cited

U.S. PATENT DOCUMENTS 5,055,058 A 10/1991 Nagasaka et al.
5,129,839 A * 7/1992 VanSkiver ..... H01R 13/6392 439/367
5,328,384 A * 7/1994 Magnuson ..... H01R 13/6392 439/369
6,080,004 A * 6/2000 Kovacik ..... H01R 13/6392 439/352
6,250,946 B1 * 6/2001 Tardy ..... H01R 13/5213 439/367
6,666,731 B2 12/2003 Zweigle et al.
7,056,138 B2 * 6/2006 Lewis ..... H01R 13/518 174/135
7,128,618 B1 * 10/2006 Roberts ..... G01R 31/045 439/700
7,140,903 B2 * 11/2006 Pulizzi ..... H01R 13/5804 439/371
8,100,710 B1 * 1/2012 Peng ..... H01R 12/7011 439/369
8,215,978 B1 * 7/2012 Sun ..... H01R 13/639 439/369
8,277,242 B1 * 10/2012 Sun ..... H01R 13/639 439/345
8,282,411 B2 10/2012 Itzenhuiser et al.
9,761,986 B2 * 9/2017 Fathauer ..... H01R 13/502
2001/0016444 A1 8/2001 Fenger
(Continued)

FOREIGN PATENT DOCUMENTS

CN 201656093 U 11/2010

*Primary Examiner* — James Harvey
(74) *Attorney, Agent, or Firm* — Oblon, McClelland, Maier & Neustadt, L.L.P.

(57) ABSTRACT

A connector locking holder includes an electrical connector having a first connector body with a first electrical contact, and a second connector body with a second electrical contact. The first connector body is configured to be coupled to the second connector body to provide the connector in a connected state in which the first and second electrical contacts are electrically connected to each other. A holder is configured to secure the connector to an assembly which includes the connector. An attachment is configured to attach the connector to the holder only when the connector is in said connected state.

18 Claims, 7 Drawing Sheets

(56) References Cited

U.S. PATENT DOCUMENTS

| | | | | |
|---|---|---|---|---|
| 2003/0228782 | A1* | 12/2003 | Nishida | H01R 13/639 439/188 |
| 2005/0221629 | A1* | 10/2005 | Woellner | H01R 13/639 439/10 |
| 2006/0223373 | A1* | 10/2006 | Van Der Mee | H01R 13/62927 439/607.41 |
| 2007/0275589 | A1* | 11/2007 | Ohtaka | H01R 13/518 439/354 |
| 2012/0003855 | A1* | 1/2012 | Bayerbach | F16K 31/5284 439/191 |
| 2012/0252258 | A1* | 10/2012 | Solon | H01R 13/639 439/445 |
| 2014/0004755 | A1* | 1/2014 | Meggiolan | B62J 6/18 439/718 |
| 2014/0106591 | A1* | 4/2014 | Menez | H01R 13/6272 439/304 |
| 2015/0147908 | A1* | 5/2015 | Jauch | H01R 13/6215 439/574 |

* cited by examiner

CONNECTOR LOCKING HOLDER

FIELD OF THE DISCLOSURE

This disclosure relates generally to electrical connectors. More particularly the present disclosure relates to a connector locking holder for a vehicle lighting module.

DESCRIPTION OF THE RELATED ART

A connector is a device used to join electrical terminals to complete an electric circuit. The connector can include a receptacle component that receives a plug to form a physical connection between the receptacle and the plug. The receptacle has metal contacts (or other electrically conducting material) that contact with metal strips (or other electrically conducting material) of the plug establishing a metal-to-metal contact completing an electrical connection when the receptacle is joined with the plug. Typically, the receptacle is removably connected to the plug. Removable connectors allow assembly and disassembly of the connector in order to replace a faulty modules or components of a higher level electrical system.

Electrical connectors are often used in automotive lighting. For example, the main wiring harness of a vehicle may include a connector that connects to a vehicle lighting module such as a headlight or taillight. In a specific example, the connector of the main harness can be a receptacle that mates with a plug on the edge of an electronic circuit board containing at least one light emitting diode (LED) of the vehicle lighting module.

Conventional vehicle connectors typically include a locking mechanism on the connector itself to ensure that electrical connection is achieved and maintained. Such locking mechanisms increase the complexity and cost of the connectors and the modules using them. Moreover, failed quality control tests of the vehicle lighting module can often be traced to connector problems despite use of a connector locking mechanism. Similarly, connector problems are often the cause of failed lighting modules during vehicle use, leading to costly vehicle manufacturer warranty claims.

SUMMARY

Accordingly, one object of the present disclosure is to provide a connector locking holder that reduces connector related failures.

Another object is to provide a connector locking holder that makes it unnecessary to provide a connector locking mechanism on the connector itself. These and other object of the disclosure may be achieved by one or more of the following aspects.

(1) A connector locking holder includes an electrical connector including a first connector body having a first electrical contact, and a second connector body having a second electrical contact, wherein the first connector body is configured to be coupled to the second connector body to provide the connector in a connected state in which the first and second electrical contacts are electrically connected to each other; a holder configured to secure the connector to an assembly which includes the connector; and an attachment configured to attach the connector to the holder only when the connector is in the connected state.

(2) The connector locking holder of aspect (1), wherein the first connector body is a receptacle, and the second connector body is a plug configured to be mechanically connected to the receptacle.

(3) The connector locking holder of Claim 2, wherein the first contact is a conductive pin embedded within the receptacle, and the second contact is a conductive tube embedded within the plug, wherein the conductive pin and conductive tube are positioned such that the pin is friction fitted within the tube when the receptacle is mechanically connected with the plug.

(4) The connector locking holder of Claim 1, wherein the first connector body is configured to be coupled to the second connector body along a joining axis, and the attachment is configured to attach the connector to the holder along a holding axis which intersects the joining axis.

(5) The connector locking holder of Claim 4, wherein the holding axis intersects the joining axis at approximately 90°.

(6) The connector locking holder of Claim 1, wherein the holder includes a pocket having a width less than or equal to a cumulative width of the connector bodies such that the connector can only be inserted into the pocket in the connected state.

(7) The connector locking holder of Claim 6, wherein the holder includes a bottom surface and a sidewall protruding from the bottom surface to form the pocket.

(8) The connection locking holder of Claim 1, wherein the holder is dimensioned to hold the connector only in the connected state such that attaching the connector to the holder verifies proper connection of the connector.

(9) The connection locking holder of Claim 1, wherein the holder is an integral part of the assembly.

(10) The connection locking holder of Claim 9, wherein the assembly is a vehicle lighting module, and the holder forms part of a housing of the vehicle lighting module.

(11) The connector locking holder of Claim 1, wherein the attachment includes a fastener coupled to at least one of the first connector body or the second connector body; and a hole provided in the holder and configured to receive the fastener to attach the connector to the holder.

(12) The connector locking holder of Claim 8, wherein the fastener and hole are offset from a centerline such that the hole can receive the fastener only when the connector is in the connected state.

(13) The connector locking holder of Claim 12, wherein a portion of the fastener is coupled to the first connector body, and another portion of the fastener is coupled to the second connector body, and the portions of the fastener form a completed fastener when the first connector body is fully connected to the second connector body.

(14) The connector locking holder of Claim 13, wherein the fastener only fits within the hole of the holder when the portions of the fastener form the completed fastener.

(15) The connector locking holder of Claim 1, wherein the electrical connector does not include a connector locking mechanism on the first or second connector body.

(16) The connector locking holder of Claim 1, wherein the electrical connector further includes a connector locking mechanism.

(17) A vehicle lighting module including the connector locking holder of Claim 1.

(18) The vehicle lighting module of Claim 17, wherein the holder is integrally formed with a housing of the vehicle lighting module.

(19) A method for assembling a module, including mechanically joining a first connector body of an electrical connector to a second connector body of the electrical connector along a connecting axis to provide the electrical connector in a connected state; attaching the electrical connector in the connected state to a connector holder along a holding axis that intersects the connecting axis such that the connector holder restricts relative movement of the first and second connector bodies along the connecting axis to impede disconnection of the connector.

(20). The method of Claim 19, wherein the holding axis intersects the connecting axis at approximately 90°.

BRIEF DESCRIPTION OF THE DRAWINGS

The accompanying drawings, which are incorporated in and constitute a part of the specification, illustrate one or more embodiments and, together with the description, explain these embodiments. The accompanying drawings have not necessarily been drawn to scale. Any values dimensions illustrated in the accompanying graphs and figures are for illustration purposes only and may or may not represent actual or preferred values or dimensions. Where applicable, some or all features may not be illustrated to assist in the description of underlying features. In the drawings.

DETAILED DESCRIPTION

Figure 1A:
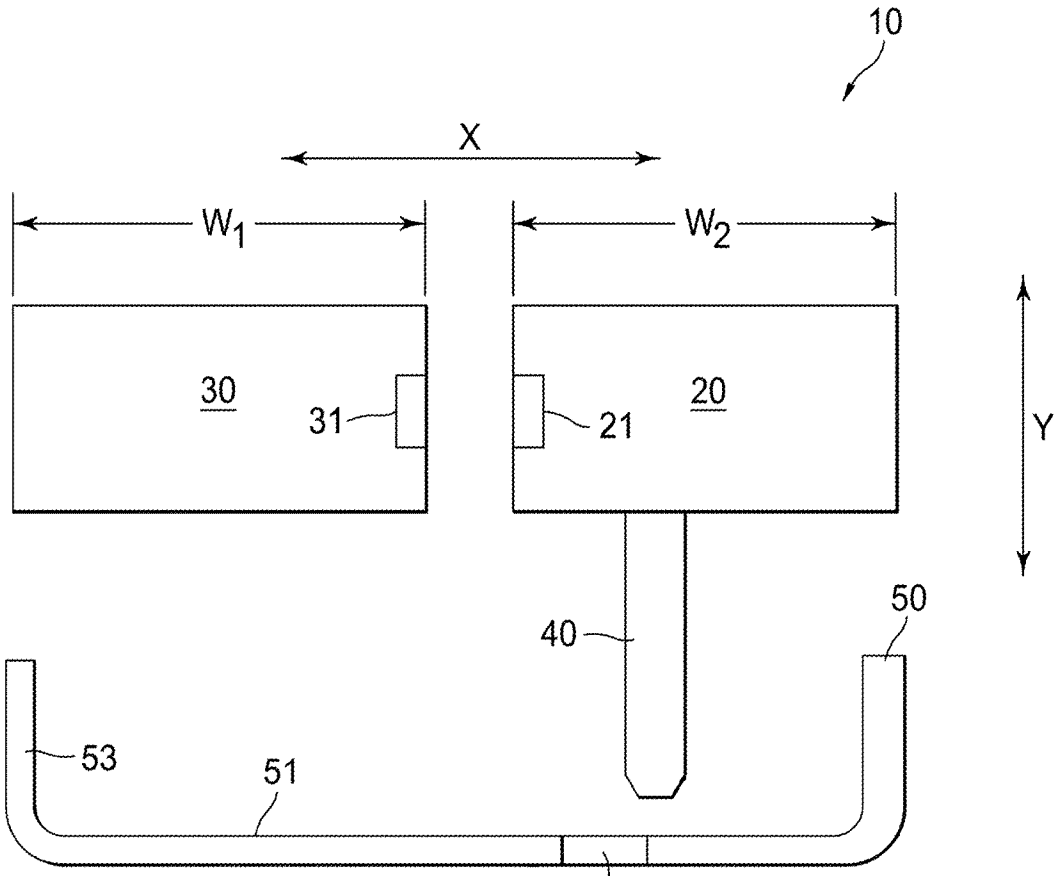
FIG. 1A is a schematic view of a connector locking holder in an intermediate stage of assembly, according to an exemplary embodiment of the present disclosure.

The description set forth below in connection with the appended drawings is intended as a description of various embodiments of the disclosed subject matter and is not necessarily intended to represent the only embodiment(s). In certain instances, the description includes specific details for the purpose of providing an understanding of the disclosed embodiment(s). However, it will be apparent to those skilled in the art that the disclosed embodiment(s) may be practiced without those specific details. In some instances, well-known structures and components may be shown in block diagram form in order to avoid obscuring the concepts of the disclosed subject matter.

It is to be understood that terms such as "front," "rear," and the like that may be used herein merely describe points of reference and do not necessarily limit embodiments of the present disclosure to any particular orientation or configuration. Furthermore, terms such as "first," "second," "third," etc., merely identify one of a number of portions, components, and/or points of reference as disclosed herein, and likewise do not necessarily limit embodiments of the present disclosure to any particular configuration or orientation.

Furthermore, the terms "approximately," "proximate," "minor," and similar terms generally refer to ranges that include the identified value within a margin of 20%, 10% or preferably 5% in certain embodiments, and any values therebetween.

As noted above, locking mechanisms provided on the connector itself increase the complexity and cost of an electrical connector, and may not prevent connector problems that lead to failed lighting modules. The present inventor has recognized that at least some of these failures are caused by improper connection of the electrical connector during assembly of the higher level module containing the connector. During assembly, joining of a connector may be a blind operation in which the assembly worker cannot have direct view of the connection being made. This blind operation may be desirable so that the connector will not be visible in the final lighting module such as a head lamp assembly. Moreover, safety gloves and hearing protection used in a production environment can make it difficult for workers to perceive audible or tactile feedback that may confirm proper connection of the connector. This leads to connectors that are not be properly engaged, or even broken, on the assembly line.

For example, the connector may be only partially joined during assembly without completing electrical connectivity, leading to failed functional testing of the lighting module on the assembly line. Alternatively, partial engagement or damage of the connector locking mechanism may provide temporary electrical connection sufficient to pass quality control functional testing, but vibration and/or other operating conditions of the vehicle will cause subsequent disconnection and module failure. Improper connection of the connector during assembly may also cause the associated wiring harness to have a different routing than intended by design.

Even where the electrical connector is properly connected during assembly, failures may occur due to operating conditions. For example, the present inventor has recognized that fully mated connectors that are loosely secured within a lighting assembly can rattle or vibrate causing mechanical degradation of the connector. Moreover, complex functionality of modern vehicle lighting modules can cause connector related failure of vehicle lighting modules that have been properly assembled. For example, movement from a dynamic leveling feature of a vehicle headlight can cause stress where a connector is mated with an edge plug of an LED board within the lighting module.

Figure 1B:
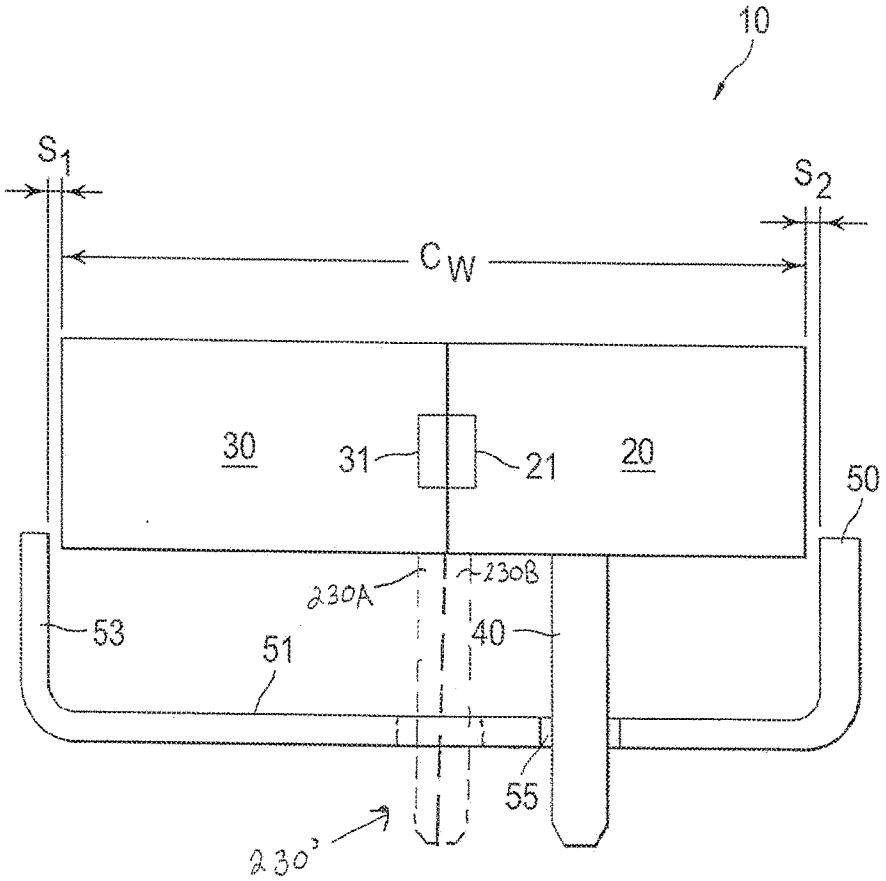
FIG. 1B is a schematic view of the connector locking holder of FIG. 1A at a completed stage of assembly, according to an exemplary embodiment of the present disclosure.

One or more embodiments of a connector locking holder disclosed herein are directed to minimizing connector related failures. FIGS. 1A and 1B are schematic drawings illustrating an intermediate stage and a completed stage of assembly for a connector locking holder according to an example embodiment. As seen, the connector locking holder 10 includes a connector having a first connector body 20 with a first electrical contact 21, and a second connector body 30 with a second electrical contact 31. The connector bodies are preferably made of an electrically insulating material such as plastic and the contacts are made from any suitable conduction material such as metal. In the embodiment illustrated, a fastening element 40 is coupled to the first connector body 20.

The connector is attached to a connector holding member 50, which may be a separate part, such as a bracket, or form part of a higher level module. The connector holding member 50 includes a through hole 55 in the bottom wall 51 for receiving the fastening element 40 such that the connector is attached to the holding member 50. Sidewall 53 of the holding member defines a pocket which holds the connector in a connected state and serves as a restricting feature to resist disconnect of the connector as discussed further below.

Prior to assembly of the connector locking holder 10, the connector bodies 20 and 30, and the holding member 50 are separated from each other as shown in FIG. 1A. During assembly, connector bodies 20 and 30 are joined together along a joining axis X such that contacts 21 and 31 of the respective connector bodies are electrically connected to each other as shown in FIG. 1B. The connector bodies 20 and 30 are then moved to align the fastening member 40 with the through hole 55, and the connector is moved along holding axis Y so that the fastening element 40 engages the through hole 55 to join the connector with the connector holding member 50, as also shown in FIG. 1B.

The connector bodies 20 and 30 are dimensioned such that, in a fully connected state, the connector fits within a pocket formed by opposing faces of the sidewall 53. That is, in the embodiment shown, the widths W1 and W2 of the respective connector bodies are set so that their cumulative width CW is the same or less than a width of the pocket of the holding member 50. Preferably, the cumulative width CW permits spaces S1 and S2 at opposing ends of the connector to provide tolerance for inserting the connector into the pocket of holding member 50 as seen in FIG. 1B. Spaces S1 and S2 are preferably set such that the connector can only fit within the pocket in a fully connected state where the contacts are electrically connected. This allows the pocket of the holding member to provide verification that the connector is properly connected. Further, even if the connector bodies 20 and 30 tend to move away from each other or "back out" due to vibration, the sidewall 53 acts as a restricting member to prevent separation of the connector bodies to the extent of electrical disconnection or "backing out" of the connector. This feature, along with the fastening member provides connector locking function of the holding member, making it unnecessary to provide a locking mechanism on the connector itself.

Figure 2:
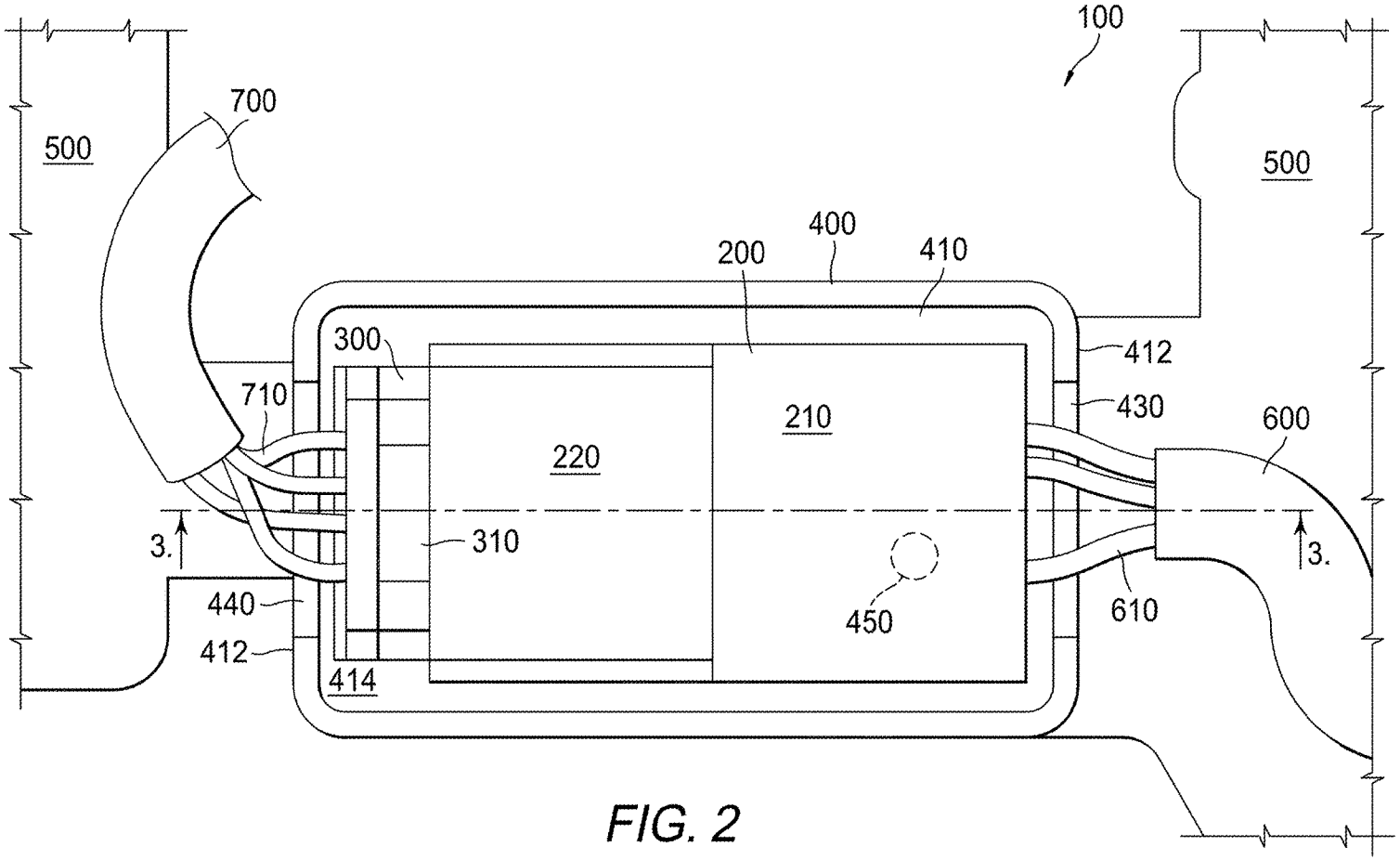
FIG. 2 is a top planar view of a connector locking holder as part of a higher level assembly module according to an exemplary embodiment of the present disclosure.
Figure 3:
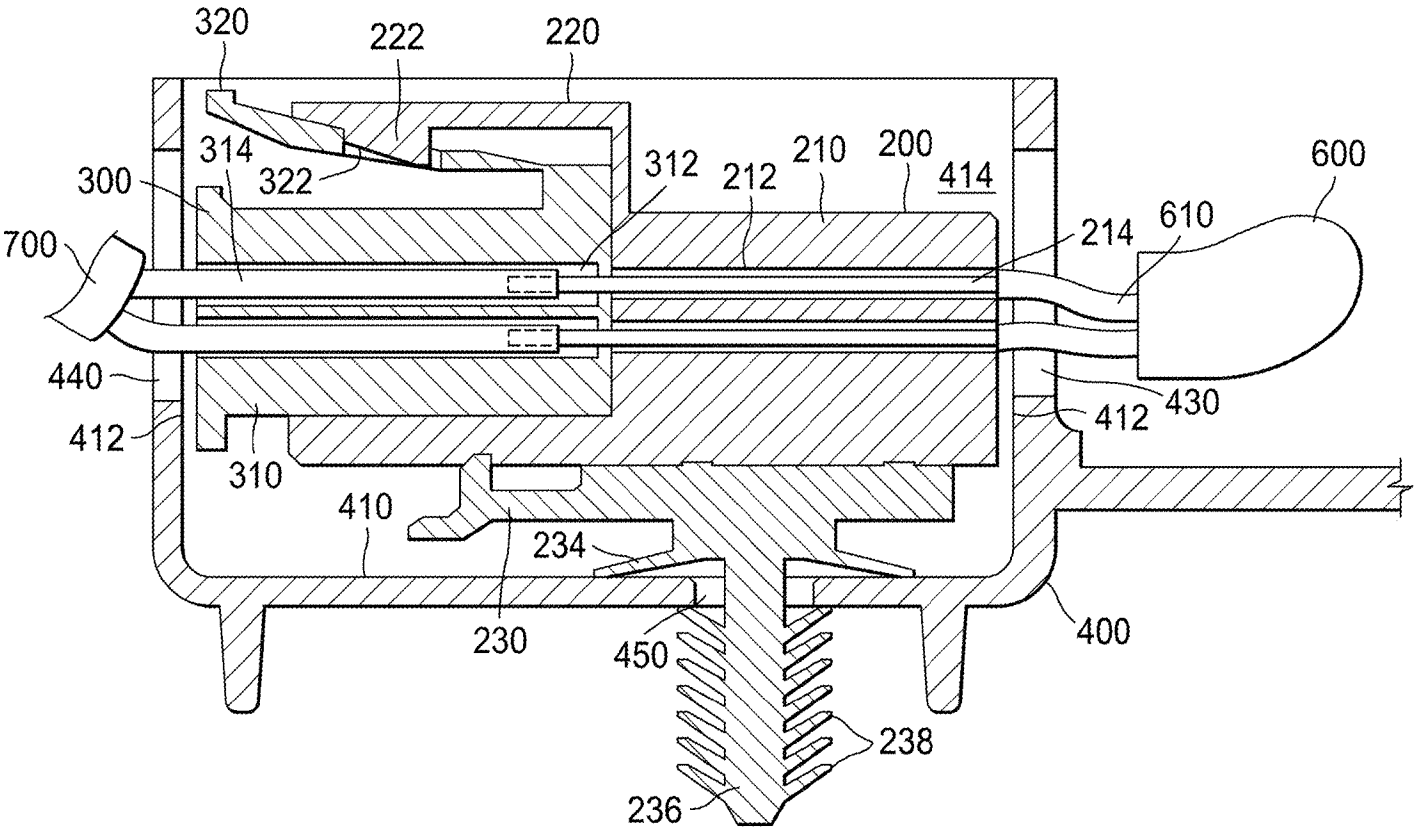
FIG. 3 is a side cross-sectional view of the connector locking holder of FIG. 2 according to an exemplary embodiment of the present disclosure.

FIG. 2 is a top planar view of a connector locking holder as part of a higher level assembly module according to an exemplary embodiment of the present disclosure, and FIG. 3 is a side cross-sectional view of the connector locking holder of FIG. 2. In the embodiment of these figures, the connector locking holder 100 includes a connector receptacle 200, a connector plug 300, and a bracket 400. The bracket 400 serves as a connector holding member and is part of a housing 500 of a higher level assembly, such a vehicle lighting module. Bracket 400 may be a separate part that is fixed to the housing 500, or integrally formed as part of the housing 500. As seen, the connector receptacle 200 is provided at the end of wiring harness 600 having wires 610, and the connector plug 300 is provided at the end of wiring harness 700 having wires 710. When the receptacle 200 is connected to the plug 300 the wires 610 make electrical contact with respective wires 710, as will be discussed further below.

In the connected state, the connector plug and receptacle are provided within bracket 400. Bracket 400 includes a bottom surface 410 and bracket walls 412 protruding from the bottom surface 410 to form a pocket 414 for accommodating the connector in a connected state. Openings 430 and 440 are provided in bracket walls 412 so that the wires 610, 710 of the respective harnesses 600, 700 can pass through the wall 412 when the connector parts are inserted in the pocket 414. Through hole 450 is provided in the bottom surface 410 of the bracket. As seen in FIG. 2, the through hole 450 is preferably offset from vertical and/or horizontal centerlines of the pocket 414 to ensure that a connector having a similarly offset fastener can only be installed into the bracket 400 in one configuration. This provides verification that the connector is properly connected during assembly.

As seen in FIG. 3, the connector receptacle 200 includes a wire holding portion 210 and a locking portion 220. Wire holding portion 210 includes cavities 212 (two shown) each of which accommodate an electrical contact pin 214 which electrically connects to the conductor of a respective wire 610. Locking portion 220 of the receptacle 200 includes a protrusion 222 which engages the plug 300 when the receptacle is connected to the plug as discussed further below.

The connector plug 300 includes a wire holding portion 310 and a locking portion 320. Wire holding portion 310 includes cavities 312 (two shown) each of which accommodate an electrical contact tube 314 which electrically connects to the conductor of a respective wire 710. As seen, the pins 214 and tubes 314 are axially aligned such that the pins 214 are friction fitted into respective tubes providing electrical contact when the receptacle 200 is connected to the plug 300. As seen by the dashed portion of pins 214 in FIG. 3, an electrical contact distance is determined by dimensions of the pin 214 and tube 314, as well as dimensions of the connector portions. Further, locking portion 320 includes an aperture 322 for receiving protrusion 222 of the receptacle when the receptacle 200 is connected with the plug 300. Thus, locking portion 220 of the receptacle 200 and locking portion 320 of the plug 300 provide a connector locking mechanism on the connector itself.

In the embodiment of FIGS. 2 and 3, clip 230 is joined with the receptacle 200 and serves as the fastening element. Clip 230 may be formed as an integral part of the receptacle 200 or is joined with the receptacle 200 by any suitable joining means. Further, it is to be understood that the clip 230 may be joined with the plug 30 and/or joined with both the receptacle 200 and the plug 300. For example, a portion of the clip 230 may be an integral part of the receptacle 200, and another portion of the clip 230 may be an integral part of the plug 300. This is schematically shown by the phantom structure in FIG. 1B. As seen, completed clip 230' includes a portion 230A which is part of the first connector body 20 (e.g., receptacle) and a portion 230B which is part of the second connector body 30 (e.g. plug). When the connector plug and receptacle are connected, the portions of the clip form a completed clip that can be engaged with a hole in the bracket. In such an embodiment, the hole serves as both the receiving element for attaching the clip and the restricting element to prevent the connector parts from disconnecting (by way of holding the portions of the fastener together).

Clip 230 includes a head and shaft 236 that extends downwardly from the head. In the embodiment shown, the head includes a flange 234 provided at one end of the shaft, and the shaft 236 includes a plurality of ribs 238 positioned along the shaft and protruding therefrom. The clip is made of any suitable material (such as plastic) for allowing the flange 234 and the ribs 238 to deflect under force. In the embodiment shown, the clip 230 is implemented as a common "Christmas tree" push-in type clip.

Bottom surface 410 of the bracket 400 includes a through hole 450 located for receiving the shaft 236 of the clip 230. Specifically, the clip 230 is pushed into the bracket 400 and the ribs 238 deflect to permit the shaft 236 to enter the hole 450. The ribs 238 are pitched in a direction opposite to the push in direction of the shaft 236 to provide for minimal push in force yet relatively strong holding force through spring biasing provided by one or more ribs 238. When the shaft 236 is fully inserted in the hole 450, the flange 234 deflects to bias the shaft in an opposite direction to that of the ribs 238. These opposing forces provided by the deflected flange 234 and deflected ribs 238 hold the clip (and connector) securely to the bracket 400 to minimize rattling and/or vibration of the connector in the bracket 400.

Figure 4A:
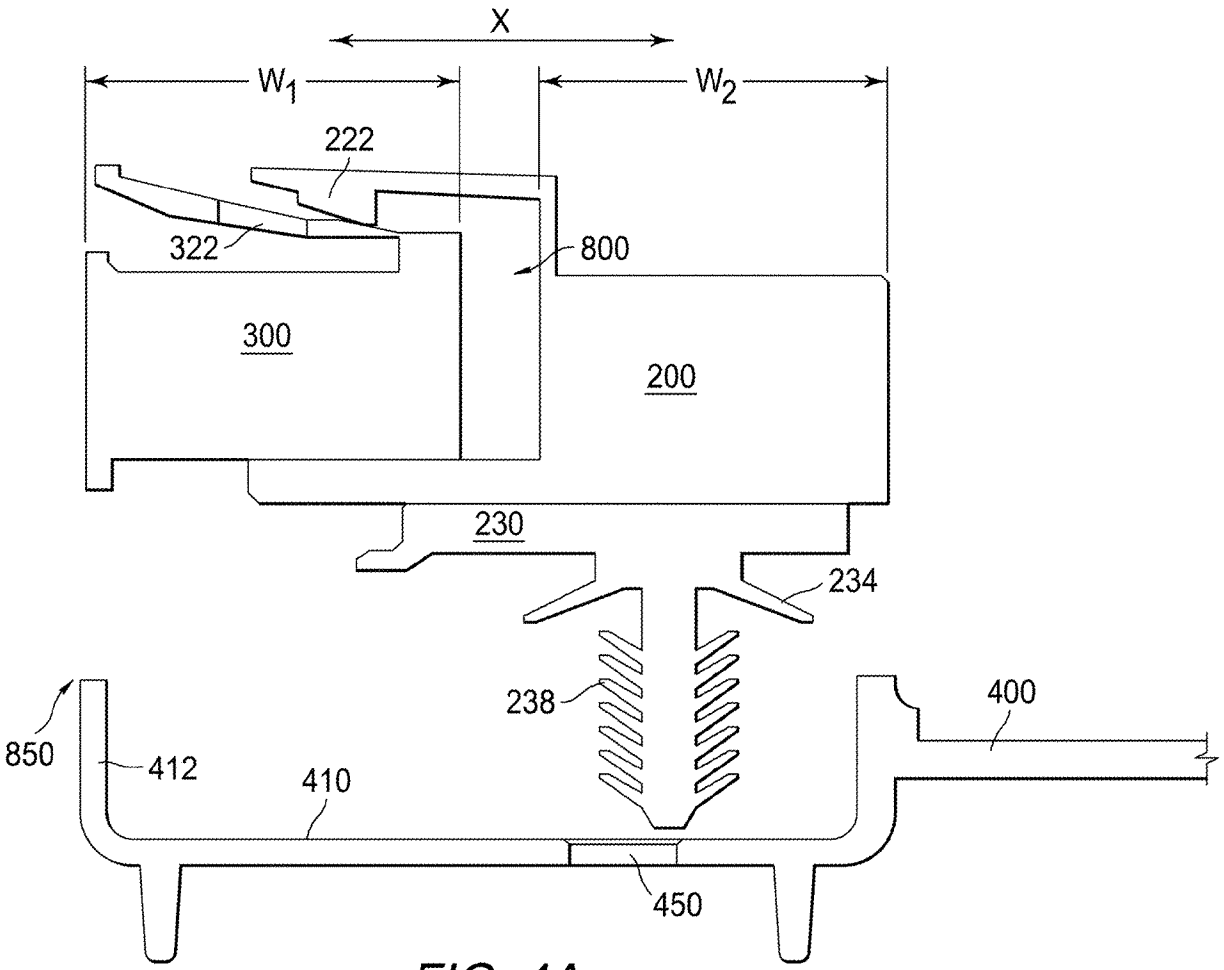
FIG. 4A is a schematic view of the connector locking holder of FIG. 3 in an intermediate stage of assembly, according to an exemplary embodiment of the present disclosure.
Figure 4B:
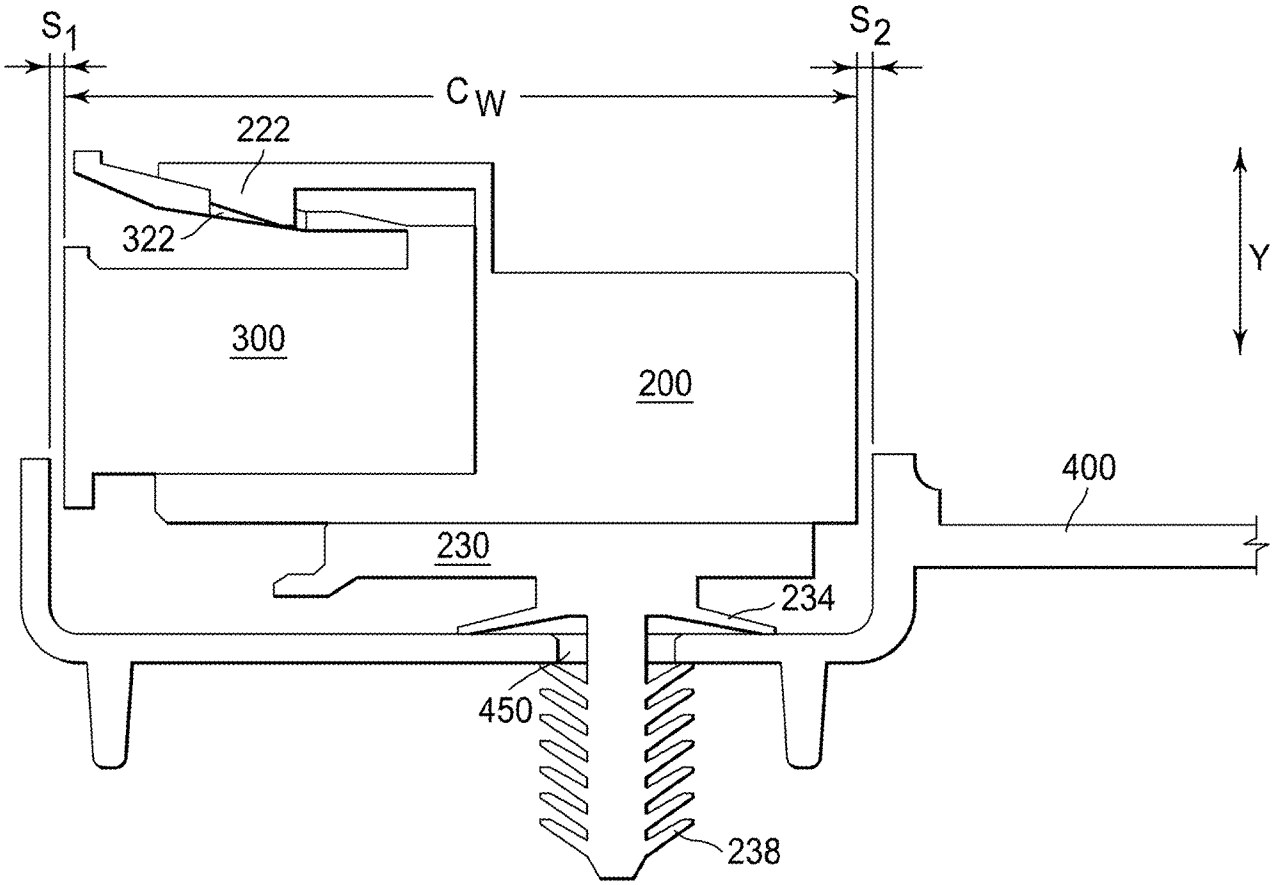
FIG. 4B is a schematic view of the connector locking holder of FIG. 3 at a completed stage of assembly according to an exemplary embodiment of the present disclosure.

FIGS. 4A and 4B are schematic drawings illustrating an intermediate stage and a completed stage of assembly for a connector locking holder according to FIGS. 2 and 3. Prior to assembly, the receptacle 200, the plug 300, and the bracket 400 are separated from each other as shown in FIG. 4A. During assembly, the receptacle 200, and the plug 300 are joined together along a joining axis X such that the receptacle and plug are electrically connected to each other. The connector is then moved to align the shaft 236 of the clip 230 with the through hole 450 of the bracket 400. The connector is then moved along holding axis Y so that the ribs 238 engage the through hole 450 to join the connector with the bracket 400 as shown in FIG. 4B.

The receptacle 200 and plug 300 are dimensioned such that, in a fully connected state, the connector fits within the pocket 414 formed by bracket 400. In the embodiment shown, the widths W1 and W2 of the respective connector parts are set so that their cumulative width CW permits spaces S1 and S2 at ends of the connector when inserted into the holding member 50 as seen in FIG. 4B. Spaces S1 and S2 are set such that the connector can only be inserted into the bracket 400 in a properly connected state. Further, even if the receptacle and plug tend to back out of connection in the bracket 400, the pocket 414 acts as a restricting member to prevent separation of the connector ports to the extent of electrical disconnection.

Accordingly the embodiment of FIGS. 2-4 provides a through hole in the bracket where the fully connected connector and Christmas tree clip can be attached on an aluminum bracket. This provides secure holding of the connector to minimize rattling of mechanical degradation of the connector that would otherwise from vibration of a connector loosely secured to the module.

Further, the clip and through hole are offset in the pocket to provide a "self-centering" pocket in the bracket. This permits easy attachment of the connector during "blind assembly" if desired, for example, to permit the connector to be mounted on the back of bracket so as to be hidden from sight in the final light assembly, or to ensure proper wire harness routing in the final assembly. Proper blind connection of the connector parts can be confirmed by the connector being properly sealed in the pocket, and by verifying that the shaft of the Christmas tree clip protrudes from an opposite side of the through hole.

Further, the attachment pocket of the bracket provides blocking/validation walls so that if connection of the connector is not correct during assembly, it will not fit into the pocket for the next stage of assembly. That is, the hard attachment inside pocket, and the pocket walls ensure that the connectors are always connected and will not back out.

Mechanical hard attachment of the connector to the bracket can also relieve the load on critical components such as an LED circuit board during dynamic leveling of lighting modules. In this regard, for head lamp light modules with dynamic levelling, a secondary harness may be connected to main harness using connectors and Christmas tree clip that will be later inserted in module bracket pocket of the light module. A connector for the main vehicle harness and secondary harness can be fixed on a module bracket such that load forces from dynamic leveling are focused on Christmas tree clip and not on PCB edge connector.

Further, since a connection lock feature is done on the mating part and not on connector itself, the locking function is achieved by integration of the connector in the product (module). Thus, a secondary locking mechanism is not necessary on the connector, which simplifies and reduces cost of the connectors.

Figure 5:
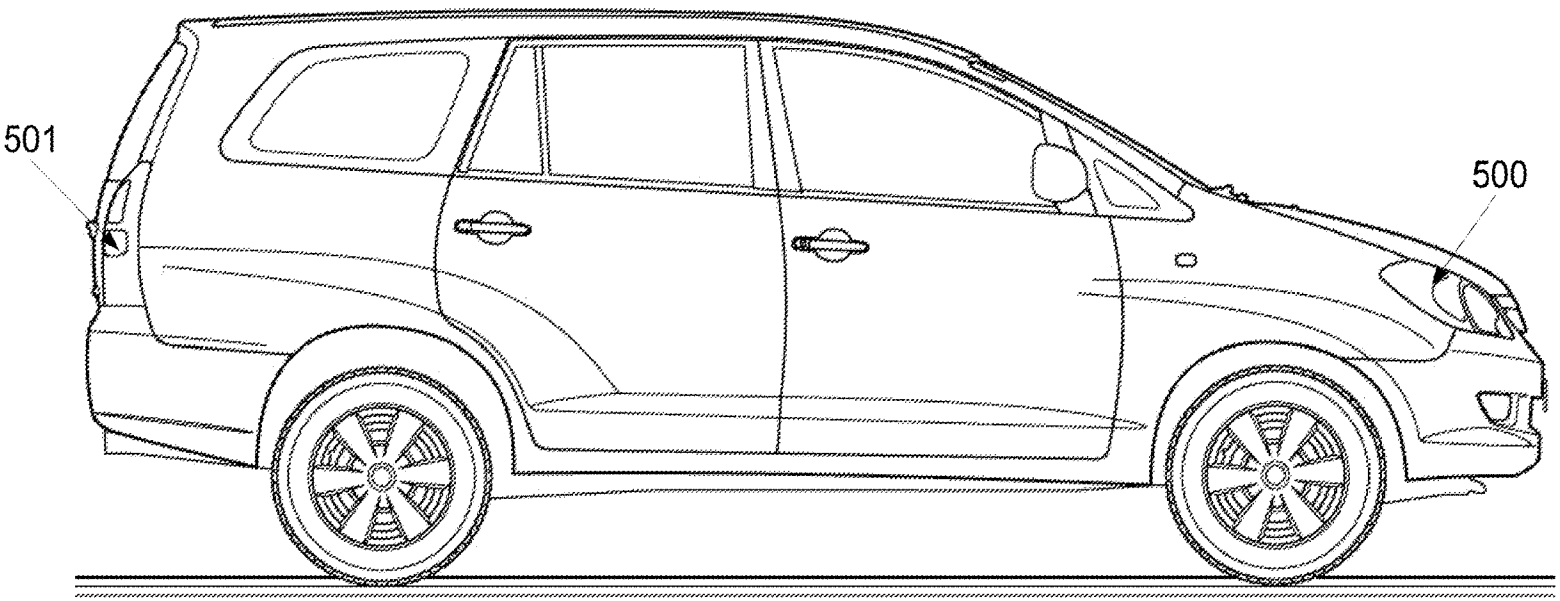
FIG. 5 is a schematic view of a vehicle having lighting modules that may include a connector locking holder according to an exemplary embodiment of the present disclosure.

FIG. 5 illustrates a vehicle according to an embodiment of the present disclosure. The vehicle can be a headlight 500, taillight 501, or other lighting apparatus installed on a vehicle. The lighting module includes the connector holding unit in accordance with any of the embodiments disclosed herein. The lighting module can includes a processing circuit configured to perform the lighting function of the vehicle such as turning the head light on or off, activating blinkers or turning lights, flashing the headlight 500, etc. Note that the lighting modules are presented by way of example and is not limited to the lighting apparatus of a vehicle. The lighting apparatus 500 can be any other electric or electronic device that requires and a connector.

While certain embodiments have been described, these embodiments have been presented by way of example only, and are not intended to limit the scope of the present disclosures. Indeed, the novel apparatuses and systems described herein can be embodied in a variety of other forms; furthermore, various omissions, substitutions and changes in the form of the apparatuses and systems described herein can be made without departing from the spirit of the present disclosures. The accompanying claims and their equivalents are intended to cover such forms or modifications as would fall within the scope and spirit of the present disclosures.

What is claimed is:

1. A connector locking holder comprising:

an electrical connector comprising a first connector body having a first electrical contact, and a second connector body having a second electrical contact, wherein the first connector body is configured to be coupled to the second connector body along a joining axis to provide the connector in a connected state in which the first and second electrical contacts are electrically connected to each other, the electrical connector further comprising a fastener coupled to at least one of the first connector body and the second connector body such that the fastener protrudes from the electrical connector along a holding axis which intersects the joining axis; and a holder configured to secure the connector to an assembly which includes the connector wherein the holder comprising an engaging element configured to engage said fastener such that the fastener and the engaging element provide an attachment configured to attach the connector to the holder along said holding axis only when the connector is in said connected state; a hole is provided in the holder and configured to receive said fastener along said holding axis to attach the connector to the holder.

2. The connector locking holder of claim 1, wherein the first connector body is a receptacle, and the second connector body is a plug configured to be mechanically connected to said receptacle.

3. The connector locking holder of claim 2, wherein said first contact is a conductive pin embedded within the receptacle, and the second contact is a conductive tube embedded within the plug, wherein the conductive pin and conductive tube are positioned such that the pin is friction fitted within the tube when the receptacle is mechanically connected with the plug.

4. A method for assembling a module, comprising:

mechanically joining a first connector body of an electrical connector to a second connector body of the electrical connector along a connecting axis to provide the electrical connector in a connected state, wherein the electrical connector includes a fastener coupled to at least one of the first connector body and the second connector body such that the fastener protrudes from the electrical connector along a holding axis which intersects the joining axis; and attaching the electrical connector in the connected state to a connector holder by engaging the connector with a hole in the holder along said holding axis that intersects the connecting axis such that the connector holder restricts relative movement of the first and second connector bodies along the connecting axis to impede disconnection of the connector.

5. The connector locking holder of claim 1, wherein the holding axis intersects the joining axis at approximately 90°.

6. The connector locking holder of claim 1, wherein the holder includes a pocket having a width less than or equal to a cumulative width of the connector bodies such that the connector can only be inserted into the pocket along said holding axis when the connector is in said connected state.

7. The connector locking holder of claim 6, wherein the holder includes a bottom surface and a sidewall protruding from said bottom surface to form said pocket, said sidewall protruding from the bottom substantially along said holding axis.

8. The connection locking holder of claim 1, wherein the holder is dimensioned to hold the connector only in said connected state such that attaching the connector to the holder verifies proper connection of the connector.

9. The connection locking holder of claim 1, wherein the holder is an integral part of said assembly.

10. The connection locking holder of claim 9, wherein the assembly is a vehicle lighting module, and the holder forms part of a housing of the vehicle lighting module.

11. The method of claim 4, wherein the holding axis intersects the connecting axis at approximately 90°.

12. The connector locking holder of claim 1, wherein said fastener and hole are offset from a centerline of the connector such that the holder can receive the connector only when the hole can receive the fastener, and when the connector is in the connected state and in a predetermined orientation with the holder.

13. The connector locking holder of claim 12, wherein a portion of the fastener is coupled to the first connector body, and another portion of the fastener is coupled to said second connector body, and said portions of the fastener form a completed fastener when the first connector body is fully connected to the second connector body.

14. The connector locking holder of claim 13, wherein the connector only fits within said holder when said portions of the fastener form said completed fastener.

15. The connector locking holder of claim 1, wherein said electrical connector does not include a connector locking mechanism on the first or second connector body.

16. The connector locking holder of claim 1, wherein said electrical connector further comprises a connector locking mechanism.

17. A vehicle lighting module comprising the connector locking holder of claim 1.

18. The vehicle lighting module of claim 17, wherein the holder is integrally formed with a housing of the vehicle lighting module.

* * * * *